US009545127B1

(12) United States Patent
Sandifer

(10) Patent No.: US 9,545,127 B1
(45) Date of Patent: Jan. 17, 2017

(54) METHOD FOR CUSTOMIZING AND MANUFACTURING A COMPOSITE HELMET LINER

(71) Applicant: Alan T. Sandifer, Orlando, FL (US)

(72) Inventor: Alan T. Sandifer, Orlando, FL (US)

( * ) Notice: Subject to any disclaimer, the term of this patent is extended or adjusted under 35 U.S.C. 154(b) by 125 days.

(21) Appl. No.: 14/253,355

(22) Filed: Apr. 15, 2014

Related U.S. Application Data

(60) Provisional application No. 61/854,012, filed on Apr. 15, 2013.

(51) Int. Cl.
*A42B 3/06* (2006.01)
*A42B 3/12* (2006.01)

(52) U.S. Cl.
CPC ..... *A42B 3/121* (2013.01)

(58) Field of Classification Search
CPC ..... A42B 3/06; A42B 3/067; A42B 3/068; A42B 3/069; A42B 3/121; A42B 3/122; A42B 3/124; A42B 3/125; A42B 3/126; A42B 3/127; A42B 3/128
USPC ..... 156/64, 378, 379; 2/412, 414, 425
See application file for complete search history.

(56) References Cited

U.S. PATENT DOCUMENTS 394,512 A 12/1888 Scholz
4,432,099 A 2/1984 Grick et al.
6,178,560 B1 1/2001 Halstead et al.
8,347,419 B1 1/2013 Cleva
8,566,969 B2 10/2013 Glogowski et al.
2004/0139531 A1 7/2004 Moore, III et al.
2004/0163228 A1 8/2004 Piorkowski et al.
2005/0241048 A1 11/2005 Cattaneo
2006/0101559 A1 5/2006 Moore, III et al.
2011/0179557 A1 7/2011 Rabie
2011/0203038 A1 8/2011 Jones, Jr.
2011/0301520 A1* 12/2011 Summit ..... A61F 5/01 602/16
2013/0086733 A1 4/2013 Szalkowski et al.
2014/0208486 A1* 7/2014 Krueger ..... A42B 3/064 2/414

* cited by examiner

*Primary Examiner* — George Koch
(74) *Attorney, Agent, or Firm* — Robert C. Montgomery; Montgomery Patent & Design

(57) ABSTRACT

A method for producing a customized helmet including a computer designed composite helmet liner to be incorporated into existing and new helmet designs is provided by scanning a user's cranial region, creating a computer rendering surface model of the scan, modifying the surface model using computer aided design software, overlaying and aligning an outer helmet shell model onto the modified cranial model to define the custom liner three-dimensional space to configure the composite liner with a software algorithm including shock absorbing segments having optimal sizes, shapes, and materials, fabricating the liner in a heat sealing process to include an optional encapsulating or serial air bladder, and assembling the liner and outer helmet shell together.

29 Claims, 8 Drawing Sheets

FIRST FABRICATION METHOD 70

METHOD FOR CUSTOMIZING AND MANUFACTURING A COMPOSITE HELMET LINER

RELATED APPLICATIONS

The present invention was first described in and claims the benefit of U.S. Provisional Application No. 61/854,012, filed Apr. 15, 2013, the entire disclosures of which are incorporated herein by reference.

FIELD OF THE INVENTION

The present invention relates to a method of manufacture and design of a helmet structure to enable customization, reduced bulk, improved protection, and ease of fabrication.

BACKGROUND OF THE INVENTION

There are many sports that require the use of helmets such as football, baseball, bicycle riding, hockey, motor sports, and the like. All of these helmets differ in their overall appearance and function, but share the common goal of protecting the user's head from impact. Different areas of coverage, padding, internal suspension, and even the materials used all share the common goal of providing impact protection. These same protective properties are also important in helmets used in medical, construction, military, and law enforcement activities as well. Manufacturers and researchers are constantly on the lookout for new materials, applications, and processes to enhance the safety properties of their protective helmets. A persistent problem facing many manufacturers and researchers is developing a helmet that is more conforming to a user's head so as to substantially attenuate, or even obviate, secondary impact without adding significant costs to the production of the helmet. Accordingly, there exists a need for a means by which the protective properties of helmets can be enhanced to further their injury preventing characteristics. The development of the present invention fulfills this need.

The method of manufacture and design of the helmet of the present invention provides for a customization of the helmet, enabling fine tuning, to ensure fabricating a sufficient first shock absorbing layer by avoiding undesirable characteristics of prior art prefabricated helmets. The undesirable characteristics of prior art helmets are a mismatch, leading to the existence of air gaps, between the liner portion of the helmet and the user's cranium shape. In fact, these air gaps can create a secondary impact between the liner and the cranium, resulting in localized high impact loads of the surface areas of contact. The methods and designs of the present invention provide a cost effective method of fabricating helmets with helmet liners that substantially reduce, or obviate, secondary impact occurrences while simultaneously reducing the required thickness of the helmet layers affording impact protection. The custom helmet design of the present invention reduces the need for excessive comfort foam found in prior art helmets. The first shock absorbing layer of the present invention is custom formed to match the wearer's head, where the customization method relies on measuring and mapping the user's head using a variety of digital scanning methods. The same processes are then applied to the interior of the helmet structure. The interior of the helmet shell may also be defined with a three-dimensional CAD model used to build high volume manufacturing tools. Next, using a variety of manufacturing methods such as sculpting, additive/subtractive, machining, or the like, a protective liner is fabricated. When used in a helmet with the respective user, an exact fit is formed, thus preventing any movement of the user's head in a manner that reduces injury upon any impact.

Prior art in this field consists of helmet designs that rely upon excessive cushion layers to provide the requisite protection. Some prior art methods of fabricating such helmet designs are elaborate and costly, and rarely result in proper cranium contour and profile matching, which exacerbates the above-fore-mentioned problems.

It is an objective of the present invention to provide a customization method for a helmet that allows for fine tuning to ensure fabricating a sufficient first shock absorbing layer by avoiding undesirable characteristics such as an excessively sized second outer shell, an excessive offset of the molded liner, an extra thick second impact absorbing layer, an extra thick soft second comfort layer, excessive air contained within bladder portions (if so equipped), and large air gaps between the molded liner and the user's cranium.

It is further objective of the present invention to provide a helmet design and method of fabrication for the customized helmet and helmet liner allows for a customized composite helmet liner that can be incorporated into existing and new helmet designs resulting in significantly enhanced comfort, stability, and shock absorption safety.

It is a further objective of the present invention to afford a user better control of positioning and simpler donning and doffing of the helmet via the use of the custom liner.

It is a further objective of the present invention to provide a helmet design and method of fabrication resulting in low-cost manufacturing comparable to prior art prefabricated helmets due to prefabricated segments stored in bins of the helmet liner of the present invention, which are stored by size, shape, and material.

It is a further objective of the present invention to enable unique helmet designs and a fully customized interface between the helmet liner and the user's cranium, applicable to a wide range of protective helmets, through the use of the disclosed method of fabrication.

SUMMARY OF THE INVENTION

The helmet comprises a first outer shell fitted with a custom liner, which accurately matches a cranial topography of a user through the use of topographic cranial maps produces by scanned cranial surface data. The custom fit of the liner to the cranium and to the first outer shell results in the reduction or elimination of air gaps within the contact surfaces of the helmet, and provides reduction of an overall thickness of the protective helmet without compromising protection against concussion or traumatic brain injury occurrences. The resultant custom fit also enables enhanced surface pressure distribution to increases helmet stability before, during, and after an impact event.

The size and shape of the custom liner are customized and optimally tuned via software algorithms. The custom liner comprises a plurality of cells, which provide dimensional variations corresponding to the cranial topography of the user. This configuration forces impact loads and energy to be distributed more effectively through additional shock absorbing cell portions. Each cell is joined and held in relative position to each other by a plastic encapsulating cover made up of inwardly protruding bladders affixed to a flat web portion. Each bladder provides a thin plastic waterproof barrier containing a geometric foam or polymer segment. Each segment includes a first impact absorbing layer having an adhesively, or otherwise bonded, first comfort layer affixed along an inwardly-facing surface. The flat web portion of the encapsulating cover extends across a rear surface of the bladders, thereby acting to join and to position the cells relative to each other. Each segment, including the first impact absorbing layer and the first comfort layer, is sealed within a bladder which acts as a thin, moisture resistant skin-like plastic enclosure. The software algorithm is also employed to determine the geometric shape, orientation, and composition of foam or polymer segments incorporated into the custom liner to tailor the shock absorbing performance to a specific application or use for the helmet.

In addition to containing the segments, each bladder is preferably inflated with air to further fine tune the shape and subsequent fit of the custom liner. Each bladder is configured to form webs, or channels, which allow for air flow between adjacent segments, as desired within the bladders. The inflation of the bladders in the preferred embodiment is intended for fine tuning to a custom shape rather than to fill larger gaps to accommodate the normal cranium variations. The connecting webs act as living hinges to enable the custom liner to fold and deform in order to create the desired variable thickness three-dimensional shape that matches the scanned cranial shape intimately on the inside and the inner surface of the first outer shell. The webs are further provided with a plurality of integral ports and valves. The ports extend between adjacent bladders and act to redistribute the contained air between bladders during an impact event. The valves provide a means to inflate the bladders to a desired pressure and/or volume.

The helmet design provides for a first outer shell, a custom liner, and an optimally tuned impact absorbing layer. The optimally tuned layers are the key to decelerating the brain slowly inside the cranium in a safer, more stable helmet and preventing traumatic brain injury. Again, this optimal tuning is accomplished with a software algorithm that accounts for the shape of the first outer shell, the automated alignment and positioning of the custom scan of the user's cranium, and the subsequent automated design of the custom liner with variable thickness of the impact absorbing layer within variably shaped and sized segments.

This design allows for customization utilizing efficient manufacturing processes and equipment, through two (2) novel fabrication methods that are cost competitive with existing prefabricated molded liner portions of prefabricated helmets. High fabrication costs, technique sensitive fabrication processes, rapid prototyped, and injected/cured material options are major issues plaguing current development efforts of the prior art that create fully customized helmet designs.

The first fabrication method and design comprises: a cranial shape acquisition step, which provides a custom scan of the user's cranium and creates a surface model from the scan data; a modify scan step, which modifies the cranial shape acquisition data for optimal helmet comfort and stability; a design liner step, which selects an appropriate size and shape of the first outer shell, overlays the model of the outer shell onto the modified cranial model, and designs the segmented composite cells and bladders; an assemble liner to helmet step to assemble the finished first outer shell with the custom liner to produce a finished helmet; and, a fit to user step. The three-dimensional surface scan is then modified during a modify scan step using computer aided design software and/or haptic feedback surface modification hardware/software to allow for optimization. The design liner step utilizes a software algorithm to select a first outer shell and design a custom liner based upon the size and shape of the three-dimensional surface scan and needed shock and impact absorption capacity. A critical function of the software algorithm is scan shape alignment and first outer shell alignment and positioning. The assemble liner to helmet step is envisioned to utilize bonding methods such as, but not limited to, adhesives, fasteners, Velcro®, and the like, to produce a finished helmet.

The second fabrication method and design comprises: a cranial shape acquisition step, which provides a custom scan of the user's cranium and creates a surface model from the scan data; a modify scan step, which modifies the cranial shape acquisition data for optimal helmet comfort and stability; a design liner step, which selects an appropriate size and shape for the first outer shell, overlays the model of the outer shell onto the modified cranial model, and optimizes and designs the foam custom liner to select the appropriate foam or polymer liner blank matched to the outer shell; a mill liner blank step, which mills the custom liner to the optimized shape preferably using a CNC tool; an assemble liner to helmet step to assemble the finished first outer shell with the custom liner to produce a finished helmet; and, a fit to user step. Specifically for the second method, a single-density or multi-density soft inner liner is created by CNC milling the inside of a prefabricated, preformed liner blank to match the CAD modified cranial three-dimensional scan with the outside of the blank matching the prefabricated inside surface of the rigid first outer shell. This second fabrication method and process is particularly applicable to single-use helmets.

Either method employs a cranial shape acquisition step in which a three-dimensional surface scan of the entire cranium and the face, including every surface area to be covered by the protective helmet, is performed. Alignment markers, used to indicating surface anatomical landmarks, are adhesively affixed to areas of the cranium and facial portions to provide an anatomical coordinate system and for alignment and positioning of the helmet. Palpable or easily discernible clear surface anatomical and helmet alignment landmarks are crucial, particularly for algorithm based anatomical alignment and positioning.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
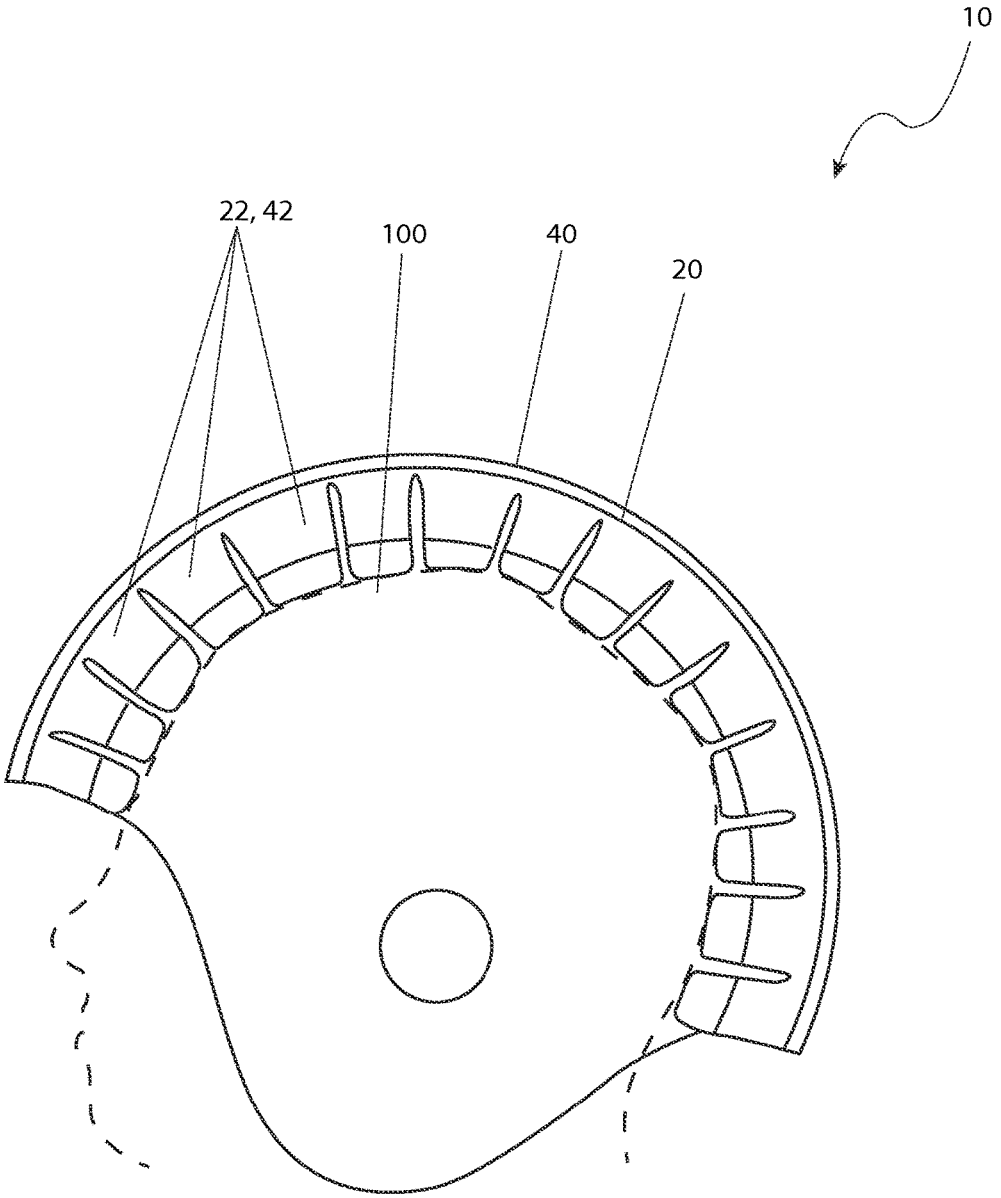
FIG. 1 is a side cut-away view of a protective helmet 10, according to a preferred embodiment of the present invention.

10 helmet
20 custom liner
22 cell
24 impact absorbing foam segment
30 impact load
40 first outer shell
41 encapsulating cover
42 bladder
43 air
44 web
45 first impact absorbing layer
46 first comfort layer
48 air gap
49*a* stiffness
49*b* damper
50*a* thickness 'T1'
50*b* thickness 'T2'
52 port
53 valve
60 first fabrication method
62 cranial shape acquisition step
63 modify scan step
64 design liner step
66 assemble shell to liner step
68 fit to user step
70 second fabrication method
75 machine liner blank step
80 marker
100 cranium
110 prefabricated helmet
115 molded liner
117 second outer shell
119 second impact absorbing layer
121 second comfort layer
122 liner

DETAILED DESCRIPTION OF THE PREFERRED EMBODIMENT

Figure 5A:
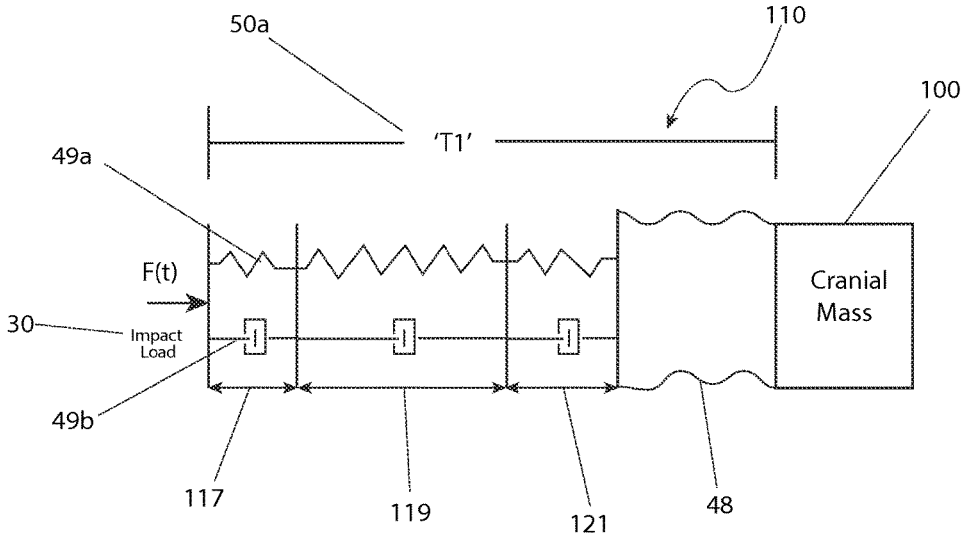
FIG. 5*a* is a diagram depicting a mathematical model of the prefabricated helmet 110 design.
Figure 5B:
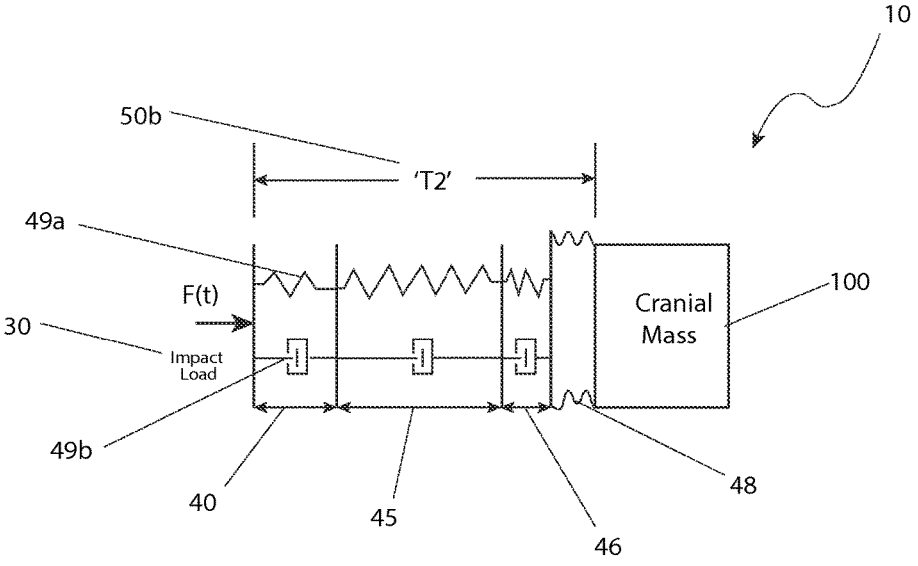
FIG. 5*b* is a diagram depicting a mathematical model of the custom helmet 10 design, according to a preferred embodiment of the present invention.
Figure 6A:
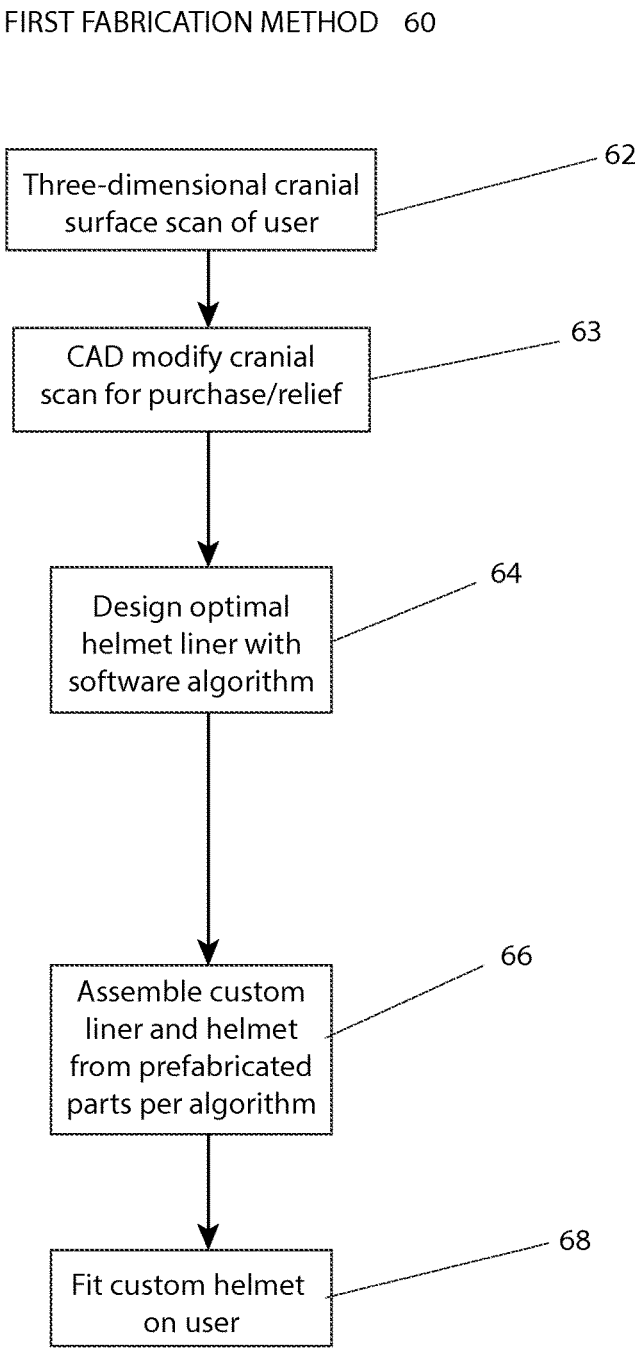
FIG. 6*a* is a process flow diagram depicting a preferred first fabrication method 60 of the protective helmet 10, according to a preferred embodiment of the present invention.
Figure 6B:
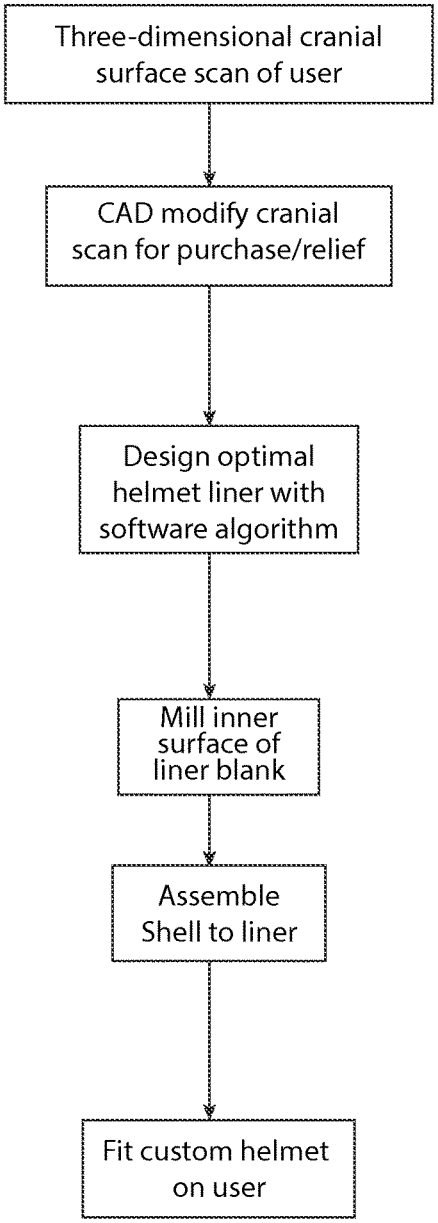
FIG. 6*b* is another process flow diagram depicting a second fabrication method 70 of the protective helmet 10, according to an alternate method; and, FIG. 7 is an illustration of alignment marker portions 80 utilized during the cranial shape acquisition step 62, according to a preferred embodiment of the present invention.

The best mode for carrying out the invention is presented in terms of its preferred embodiment 10 and fabrication method 60, herein depicted within FIGS. 1 through 6*a*, and FIG. 7, and in terms of an alternate fabrication method 70, herein depicted within FIG. 6*b*. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a protective helmet 10 and fabrication method (herein described as the "helmet"), which provides an improved design and manufacturing system developed for customized protective helmets 10 that allows for a composite helmet liner 20 that can be incorporated into existing and new helmet designs resulting in significantly enhanced comfort, stability, and shock absorption safety with custom shape alignment and fabrication/customization. The helmet 10 provides low-cost manufacturing comparable to prefabricated helmets 110 due to prefabricated segments stored in bins by size, shape, and material.

The fabrication method 60 allows for unique helmet designs 10 and a fully customized interface between the helmet liner 20 and the user's cranium 100. The envisioned design and fabrication processes can be applied to a wide range of protective helmets 10.

Referring now to FIG. 1, a side cut-away view of the helmet 10, according to a preferred embodiment of the present invention, is disclosed. The helmet 10 comprises a first outer shell 40 being fitted with a custom liner 20, which accurately matches a cranial topography of a user, thereby reducing or eliminating air gaps 48, and consequently enabling reduction of an overall thickness of the protective helmet 10 while providing equal protection against concussion or traumatic brain injury occurrences and optimal distribution of impact energy for improved protection. The custom liner 20 is made up of a plurality of cells 22 which provide dimensional variations corresponding to the cranial topography of the user.

Figure 2:
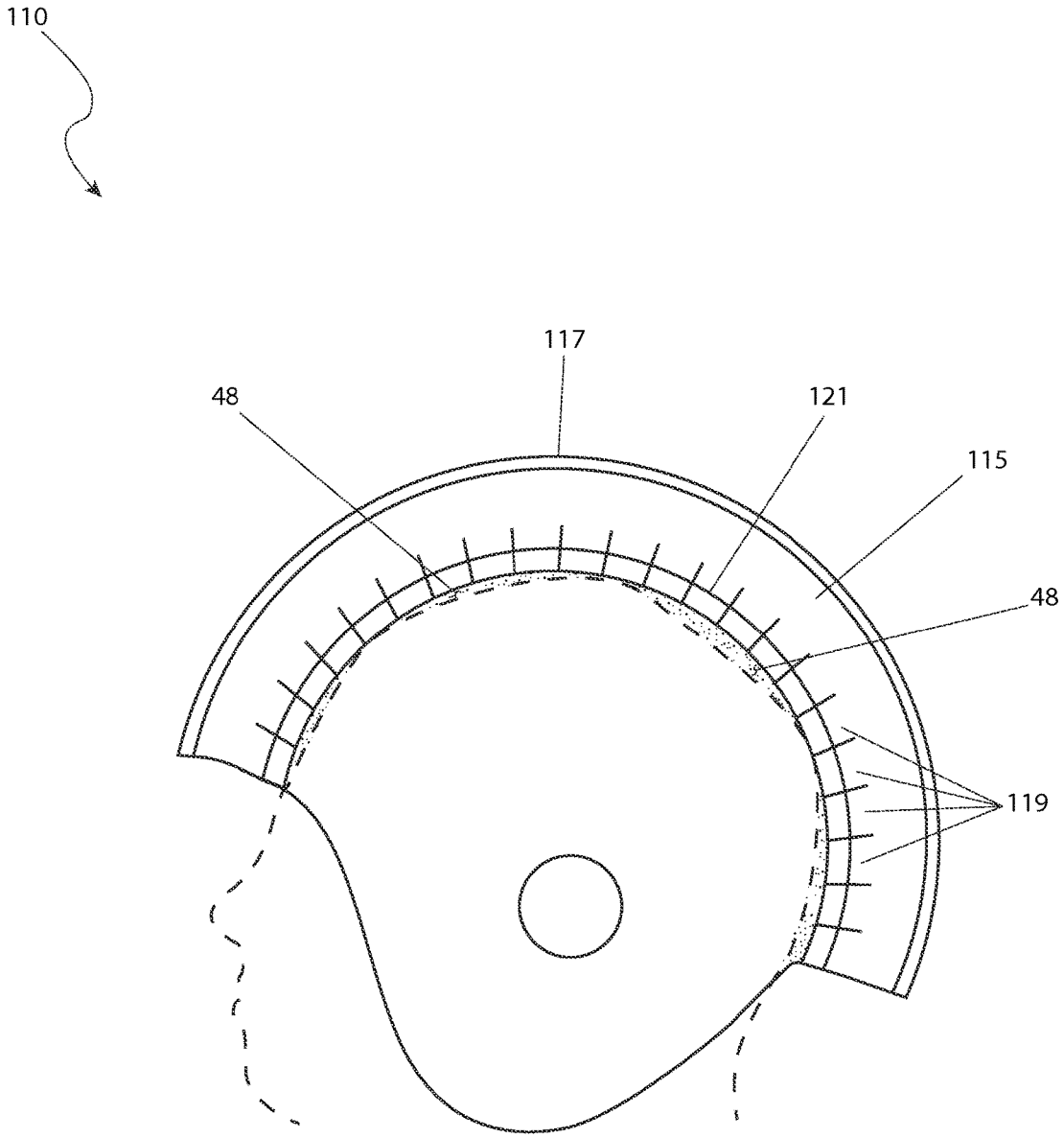
Fig. 2 (prior art)
FIG. 2 is a side cut-away view of a prefabricated helmet 110, according to a preferred embodiment of the present invention.
Figure 3:
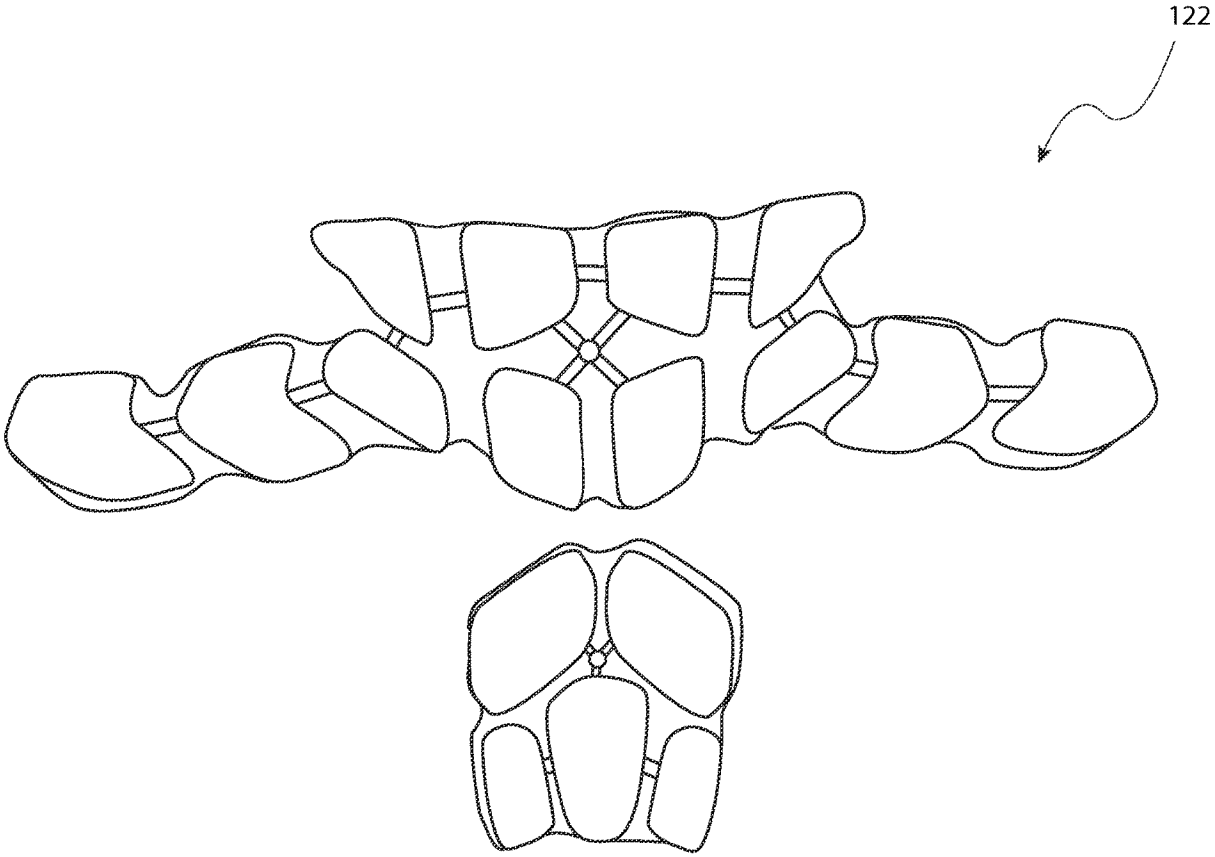
Fig. 3 (prior art)
FIG. 3 is an isolated view of a liner portion 122 of prefabricated helmet 110, according to a preferred embodiment of the present invention.

Referring now to FIGS. 2 and 3, a side cut-away view of a prefabricated helmet 110, according to the preferred embodiment of the present invention and an isolated view of a liner portion 122 of a prefabricated helmet 110, are disclosed. The design of the custom liner 20 is based upon a step 63 comprising overlaying an inner surface model of the first outer shell 40 onto cranial topography data obtained by such methods as a custom cranial scan 62, and is envisioned using software based upon quantitative algorithms and alignment markers 80 and/or qualitative positioning for controlled spacing and contoured shaping between the first outer shell 40 and cranial model. An example of potential unsafe mismatches and air gaps 48 between the inner molded foam liner 115 of an existing commercially available prefabricated protective helmet 110 and the skull/scalp are seen here. The design of the custom liner 20 allows for significantly improved surface matching for relatively even pressure distribution over a larger surface area than is possible with a prefabricated helmet 110. Impact loads 30 and energy will be distributed more effectively through additional shock absorbing cell portions 22 resulting in a safer helmet 10. The scanned cranial surface data receives subsequent customization and CAD modification to improve relief over highly innervated local areas for comfort and additional purchase. The enhanced surface pressure distribution provided by the helmet 10 increases helmet stability before, during, and after an impact event. The customization of the helmet 10 allows for fine tuning to ensure fabricating a sufficient first shock absorbing layer 45 by avoiding characteristics of a prefabricated helmet 110 such as an excessively sized second outer shell 117, an excessive offset of the molded liner 115, an extra thick second impact absorbing layer 119, an extra thick soft second comfort layer 121, excessive air 44 contained within bladder portions 42 (if so equipped), and large air gaps 48 between the molded liner 115 and the user's cranium 100. The custom liner 20 is also envisioned to provide for better control of positioning and simpler donning and doffing of the helmet 10.

The mismatch and air gaps 48 between the liner portion 115 of the prefabricated helmet 110 and the user's cranium 100 shape that are frequently present in prefabricated helmets 110 are seen here as shaded areas. The potentially large air gaps 48 between the prefabricated helmet 110 and the cranium 100 can be substantial and are often filled with air bladders that contribute minimally to shock absorbing capacity. These air gaps 48, extra comfort foam 119, 121, and air bladders 42, can create a secondary impact between the liner 115 and the cranium 100 and will cause localized high impact loads of the surface areas of contact (see FIG. 5).

The size and shape of the soft custom liner 20 are customized and optimally tuned via software algorithms for comfort, stability, impact absorption, and slower cranial deceleration. The algorithm will be user friendly software that will be simple to use for a novice who wants automated quick liner design and for expert tuning of the customization (see FIG. 6*a*).

Figure 4B:
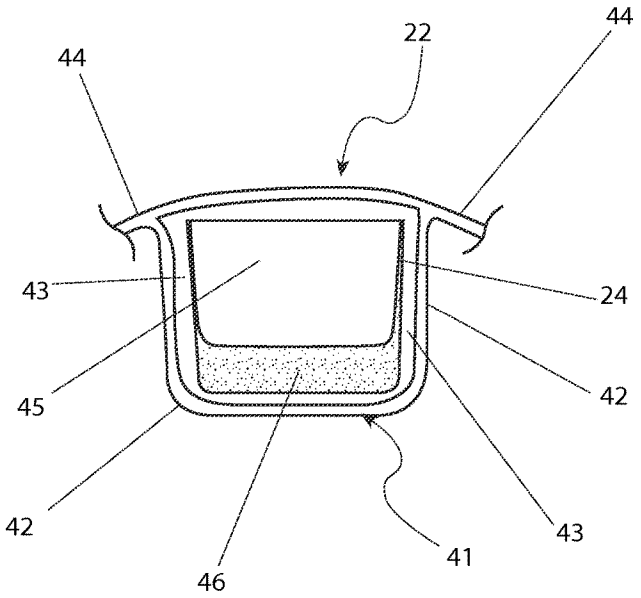
FIG. 4*b* is a sectional view of a cell portion 22 of the custom liner 20, according to a preferred embodiment of the present invention.
Figure 4A:
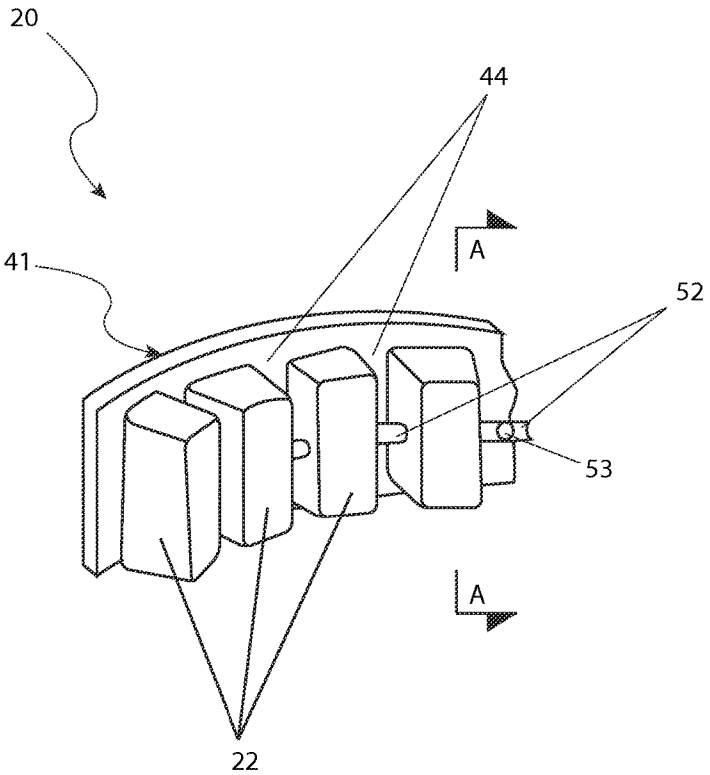
FIG. 4*a* is a close-up view of a portion of the custom liner portion 20 of the protective helmet 10, according to a preferred embodiment of the present invention.

Referring now to FIGS. 4*a*, and 4*b*, various views of the custom liner portion 20, according to a preferred embodiment of the present invention, are disclosed. The custom liner 20 includes a plurality of segmented cells 22 joined and held in relative position to each other by a plastic encapsulating cover 41 made up of inwardly protruding bladders 42 affixed to a flat web portion 44 positioned along an outer surface. Each bladder 42 provides a thin plastic waterproof barrier containing a geometric foam or polymer segment 24. Each foam segment 24 includes a first impact absorbing layer 45 having an adhesively, or otherwise bonded first comfort layer 46 affixed along an inwardly-facing surface. The flat web portion 44 of the encapsulating cover 41 extends across a rear surface of the bladders 42, thereby acting to join and to position the cells 22 relative to each other. Each foam segment 24, including the first impact absorbing layer 45 and the first comfort layer 46, is sealed within a bladder 42 which acts as a thin, moisture resistant skin-like plastic enclosure. In addition to containing the foam segment 24, the bladder 42 is envisioned to be inflated with air 43 to further fine tune the shape and subsequent fit of the custom liner 20.

Topographic cranial maps can be utilized to represent a three-dimensional and/or directional distance between the first outer shell 40 and the modified three-dimensional scan. The soft custom liner 20 is to be constructed from segmented, three-dimensional polygon and geometric shaped foam cells 22 with connecting webs 44, which act as living hinges to enable the relatively flat liner 20 to fold and deform in order to create the desired variable thickness three-dimensional shape that matches the scanned cranial shape intimately on the inside and the inner surface of the first outer shell 40. Additionally, the webs 44 are to include a plurality of integral ports 52 and valves 53. The ports 52 extend between adjacent bladders 42 and act to redistribute the contained air 43 between bladders 42 during an impact event. The valves 53 provide a means to inflate the bladders 42 to a desired pressure and/or volume.

The three-dimensional shape and thickness of the custom liner 20 may be created in a unique, cost-effective way by algorithm determined selection of prefabricated geometric foam or polymer foam segments 24 from an organized pre-sized and pre-shaped inventory of segments 24. The shock absorbing foam or polymer materials selected for the foam segments 24 may be different for local areas within the helmet 10 to enhance the shock absorbing performance in susceptible areas of the custom liner 20. The prefabricated foam segments 24 may be stored in bins by shape, size, foam type, and foam layer thickness.

The selection and orientation of the segments 24 will be determined with a software algorithm that calculates the variable thickness and three-dimensional shape contours between the inner and outer surfaces based upon the position inside the helmet 10 and the desired shock absorption. The prefabricated segments 24 may be manufactured via compression molding, injection molding, casting, milling, or grinding. The sets of modular prefabricated foam segments 24 are then placed inside plastic barrier or air bladder thermoforming molds, compression molds, or other heated molds for encapsulating the segments 24 inside vinyl or other water resistant, flexible, inflatable plastic bladders 42. The bladders 42 may also be utilized in series with the foam custom liner 20. Serial bladders 42 are to be rotationally molded, blow molded, thermoformed, or compression molded. The inflation of the bladders 42 in the preferred embodiment is intended for minimal fine tuning to a custom shape rather than to fill larger gaps to accommodate the normal cranium 100 variations as seen with prefabricated helmets 110.

Inflating a bladder 42 with air 43 may add comfort, and if properly inflated will help hold the helmet 10 in place during use prior to impact but contribute minimally to the absorption of the extreme forces experienced during impact events. However, these larger gaps provide minimal support and can create a significant secondary impact between the liner and the cranium 100.

Each bladder 42 is envisioned being formed in a thermoforming or heat molding process utilizing existing commercially-available machinery and requires bonding of two (2) thin vinyl, or other water resistant flexible thermoplastic sheet material, that are heated and inserted into a vacuum thermoforming mold, compression mold, or other heat molding tool. The sheets may be die cut or trimmed prior to and/or after the thermoforming or heat molding process. The inner thermoformable or heat moldable sheet remains relatively flat and the outer sheet contours to the shape of the sandwiched prefabricated segments 24 and is sealed between segments and around segments forming webs 44 or channels, which allow for air flow between adjacent foam segments 24 as desired within the bladders 42. Mechanical fastening means and/or air valves may also be molded into the web portions 44 of the thermoplastic sheets during this heat forming step. The custom liner 20 may be thermoformed, compression molded, or heat molded in an open or closed cavity manufacturing mold to create the desired shape. The custom liner 20 may then be die cut before or after molding, trimmed, and finished to create the final net shape as needed.

The prefabricated, modular, segmented, custom located foam or polymer cell 22 designs allow for customization utilizing efficient manufacturing processes and equipment that are cost competitive with existing entirely prefabricated molded liner portions 115 of prefabricated helmets 110. High fabrication costs, rapid prototyped and injected/cured material options were, and continue to be, major issues with previous development efforts to create fully customized helmet designs.

Referring now to FIGS. 5*a* and 5*b*, a diagram depicting mathematical models of the prefabricated helmet 110 and the helmet 10 designs, according to a preferred embodiment of the present invention, is disclosed. The lumped parameter mathematical models shown here are a representation of the localized helmet and liner dynamic mechanical characteristics of a prefabricated helmet 110 and the protective helmet 10 for increased understanding of the optimized design and subsequent benefits of the customization helmet 10.

From the perspective of a theoretical Impact Load, F(t) 30 that is applied to the helmets 10, 110, the first performance layers are the respective first 40 and second 117 outer shells. The outer shell mechanics can be modeled with a stiffness 49*a*, and a damper 49*b*, for a prefabricated helmet 110 and similarly for the custom helmet 10. The outer shell materials, properties and shapes are basically the same for the prefabricated and custom helmet 110, 10 where both the liner materials and outer shell are fully customized for finely tuned impingement safety and load distribution for shock absorption. The outer shell stiffness's 49*a* are relatively very high as compared to the respective liner materials. The outer shell dampening 49*b* is negligible as compared to the inner materials.

The outer shell 40 for multiple use helmets 10 is stiff and strong to resist impingement and elastically deforms during impact and distributes the impact load over the liner materials. The outer shell 40 for single use helmets 10 are often designed to permanently deform or fracture under extreme impact loads 30 to aid in the beginnings of energy absorption and transference to the underlying liner materials.

The shock absorbing foam or polymer layers 45, 46, 119, 121 can be modeled with elements of stiffness 49*a* and damping 49*b* for a prefabricated helmet 110 and similarly for the helmet 10. The shock absorbing geometry in a prefabricated helmet 110 does not typically match the variable shape of the cranium 100. As a result, the impact energy absorbed by an impact load 30 for custom helmet shock absorbing layers of prefabricated helmets 110 is distributed through a larger volume of material and the potential for localized high impact energy transference, as can occur with prefabricated helmets 110, is significantly increased. The combined impact absorption properties 49*a*, 49*b* for a custom helmet 10 are significantly enhanced over those of the prefabricated helmet 110 particularly in the very common scenario where the variability in normal cranial shape 100 causes for a mismatch between the prefabricated molded liner 115 and individual cranium 100.

The thicknesses of the first impact absorbing layer 45 and first comfort layer 46 portions of the impact foam segment 24 can optimally be reduced in a custom helmet 10, as indicated by thickness 'T2' 50*b*, and achieve the same impact safety as a prefabricated helmet 110, as indicated by thickness 'T1' 50*a*. Additionally, current commercially available prefabricated helmet 110 design trends are to increase the thickness of the impact layers 119, 121, or helmet 'offset', to increase the shock absorption capacity, as indicated by thickness 'T1' 50*a*. A larger, thicker helmet 110 can be heavier and unwieldy.

The impact absorbing foam 45 utilized in single use helmets 10 is typically designed to crush and permanently deform to absorb the impact energy from an impact load 30 while the impact foam 45 or polymer for multiple use helmets 10 is intended to elastically deform and rebound. The single use helmet 10, 110 is typically intended to be replaced after experiencing extreme impact energy.

The helmet 10 and the prefabricated helmet 110 provide respective first comfort foam layer 46 and second comfort foam layer 121 portions. The first 46 and second 121 comfort foam layers provide little shock absorbing capacity. The stiffness 49*a* and damping 49*b* are negligible and are very low and nonlinear. The comfort foam 121, 46 deflects very quickly 'bottoming out' and then becoming rigid. The comfort foam 121, 46 is a soft foam for comfort, some stability, and to fill the mismatch between the prefabricated helmet 10, 110 and the cranium 100. The custom helmet 10 reduces the need for excessive comfort foam 121 found in commercially available prefabricated helmets 110. Air gaps 48 and soft comfort foam layers 121, 46 provide no support during or after impact and can create a significant secondary impact between the liner and cranium 100.

Likewise, the air 43 within the bladders 42 provides only minimal shock absorption capacity by acting as closed volume air cushions or by forcing air 43 through channels or orifices formed within or between the bladders 42 (see FIG. 4*b*). The bladders 42 do provide adjustable comfort and some stability prior to impact situations. The potentially large air gaps 48 between the prefabricated helmet 110 and the cranium 100 can be substantial. Air bladders 42 are most commonly utilized with multiple use helmets. Without air bladders 42, these air gaps 48 can be filled with comfort foam 121 or may create a sloppy fit of the helmet 110 on the cranium 100. These air gaps 48, extra comfort foam 121, or air bladders 42 can create a secondary impact between the liner 115 and the cranium 100 and will cause localized high impact loads 30 of the surface areas of contact. The custom helmet 10 will maximize the surface areas of contact.

The custom helmet 10 and prefabricated helmet 110 provide respective first impact absorbing layer 45 and second impact absorbing layer 119 portions envisioned to be made of a foam or polymer material. The optimal measure of helmet 10, 110 fit as it relates to impact absorption safety, stability, and fit is how the shape of the impact absorbing layer 45, 119 matches the shape of the individual cranium 100. An optimally tuned, well-fitting impact absorbing layer 45, 119 is the key to decelerating the brain slowly inside the cranium 100 in a safer, more stable helmet and preventing traumatic brain injury. This optimal tuning is to be accomplished with a software algorithm that accounts for the shape of the first outer shell 40, the automated alignment and positioning of the custom scan of the user's cranium 100, and the subsequent automated design of the custom liner 20 with variable thickness of the first impact absorbing layer 45 within variably shaped and sized foam segments 24, and variable materials for the desired significantly enhanced shock absorption, stability, and fit.

Materials to be utilized for single use applications of the protective helmet 10 may include, but not be limited to: acrylonitrile butadiene styrene (ABS), polycarbonate or fiber reinforced polymer composites for the first outer shell 40; expanded polystyrene foam or Expanded Polypropylene foam for the first impact absorbing layer 45; and ethylene-vinyl acetate (EVA) foam, polyurethane foam or polyolefin foams for the first comfort layer 46. Materials to be utilized for multiple use application of the helmet 10 may include, but not be limited to: polycarbonate, ABS or fiber reinforced polymer composites for the thicker first outer shell 40; vinyl nitrile foam, expanded polypropylene foam, polyurethane foam or polyurethane polymer for the first impact absorbing layer 45; and EVA foam, polyurethane foam or polyolefin foams for the first comfort layer 46.

The protective helmet 10 may be fabricated via different manufacturing methods as seen in the flowcharts illustrated on FIGS. 6*a* and 6*b*.

Referring now to FIG. 6*a*, a process flow diagram depicting a preferred first fabrication method 60 of the helmet 10, according to a preferred embodiment of the present invention, is disclosed. The custom helmet 10 provides optimized contact pressure distribution and optimized user cranial positioning and alignment for significantly improved surface matching to cranial shape variations. This technology will make helmet wear more comfortable, improve stability, and significantly improve shock absorption mechanics. A first fabrication method 60 is presented herein which allows for a cost-effective custom helmet 10 to effectively compete with the prefabricated helmet 110 marketplace.

The first fabrication method 60 and design includes a cranial shape acquisition step 62, which provides a custom scan of the user's cranium 100 and creates a surface model from the scan data; a modify scan step 63 which modifies the cranial shape acquisition data for optimal helmet 10 comfort and stability; a design liner step 64 which selects an appropriate size and shape of the first outer shell 40, overlays the model of the outer shell 40 onto the modified cranial model, and designs the segmented composite cells 22 and bladders 42; an assemble liner to helmet step 66 to assemble the finished first outer shell 40 with the custom liner 20 to produce a finished helmet 10; and, finally a fit to user step 68.

The first process method 60 begins with the cranial shape acquisition step 62 to acquire a three-dimensional cranial surface scan. Prior to non-contact laser scanning, the cranium 100 being scanned is to be covered with a stretchable fabric or thin material to compress the hair and scalp similarly to a protective helmet and to mask the hair for scanning. Alternatively, the hair may be moistened or 'wet-down' with lubrication or hair conditioner to simulate actual usage conditions without stray hairs. The cranial shape acquisition step 62 may be accomplished using various commercially available non-contact laser scanning equipment that can be utilized to create a surface model of the entire surface of the user's cranium 100 that would be covered as previously described. Each of these scanning systems utilizes projected light and single or multiple cameras to image the projected light on the cranium 100. Preferably a non-contact cranial laser scanner would be used, having multiple fanned lasers to project light circumferentially around the cranium 100. Multiple cameras generate images of the projected laser light which can be triangulated through control of the position and movement of the lasers and cameras. The cross-sectional slice coordinate data can then be combined to create a three-dimensional cranial surface model with surface lofting, sweeping, meshing, and interpolation. The three-dimensional cranial surface scan may also be acquired through various other scanning technologies including CT, MRI, photogrammetry, infrared/ultraviolet light scanning, or flexible, contourable, stretchable fabrics that conform to the cranial surface and contain a matrix of shape and/or position sensors.

Figure 7:
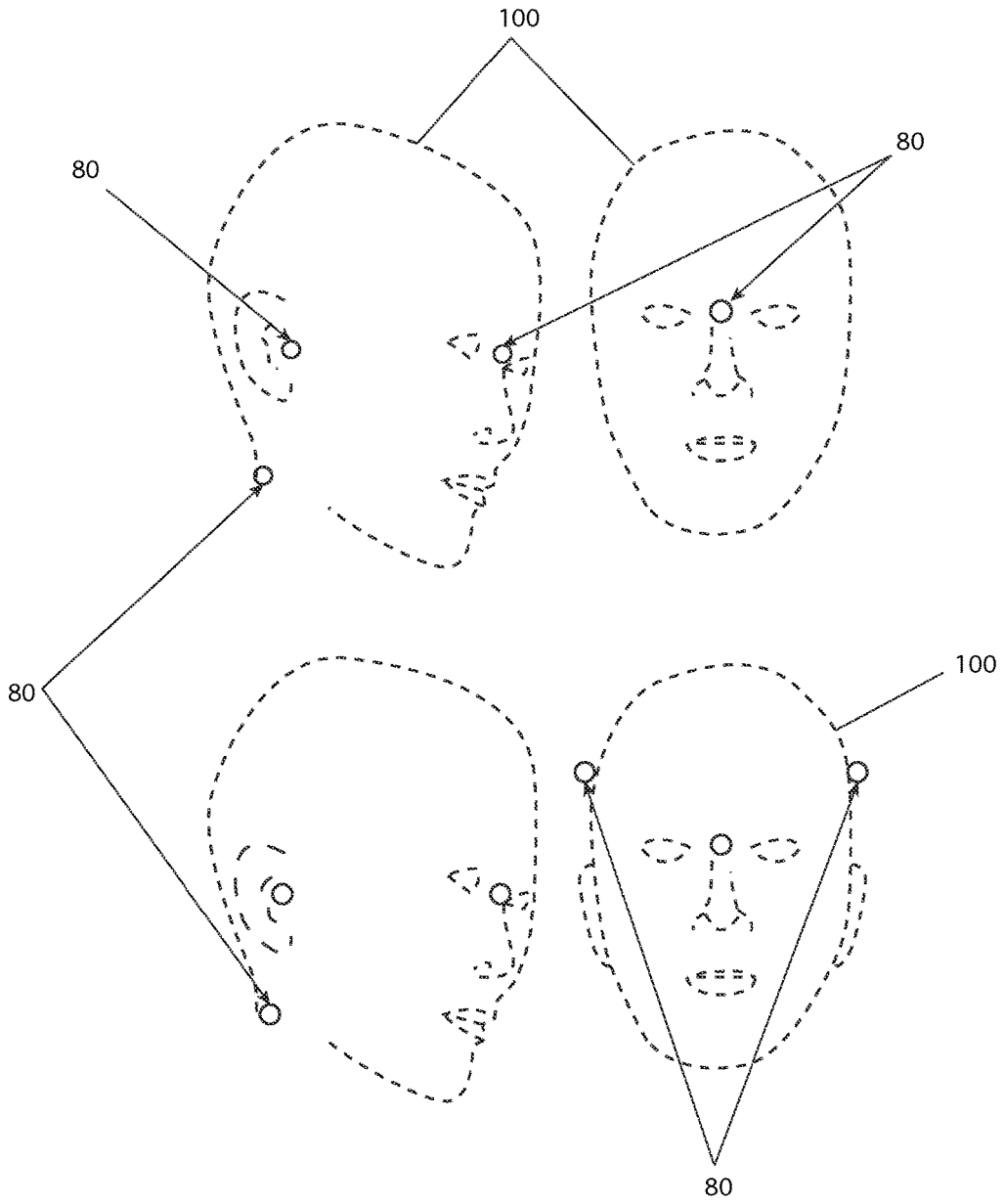

It is envisioned that detectable alignment markers 80 indicating surface anatomical landmarks be affixed to the cranium 100 during the cranial shape acquisition step 62 and for alignment and positioning of the helmet 10 (see FIG. 7).

The three-dimensional surface scan is then modified during a modify scan step 63 using computer aided design software and/or haptic feedback surface modification hardware/software to allow for optimized pressure distribution, fit and subsequent stability and shock absorbing performance of the helmet 10 upon the cranium 100. CAD/CAM modification and software algorithm based helmet 10 and liner 20 designed shapes and sizes are standardized and automated for these customized helmets.

Next, a design liner step 64 utilizes a software algorithm to select a first outer shell 40 and design a custom liner 20 based upon the size and shape of the three-dimensional surface scan and needed shock and impact absorption capacity. The software algorithm is utilized to select the appropriate prefabricated, sized, shaped, cost-effectively manufactured first outer shell 40. The first outer shell 40 serves to prevent impingement and spreads the impact forces 30 onto a maximized volume of shock absorbing material. The spreading of the impact energy to maximize the use of the shock absorbing material is very much dependent on the shape match of the custom liner 20 to the user's cranial shape 100. Excessive air gaps 48, excessive thickness of the second comfort layer 121, or excessive air 43 within bladders 42 that are very common with prefabricated helmets 110 compromise shock absorption capacity and can cause an additional damaging impact between the molded liner 115 and cranium 100. Air gaps 48 and air 43 within air bladders 42 are minimal or negligible with the custom liner 20 thus preventing or eliminating this secondary impact.

The software algorithm has the following inputs: the raw cranial scan; the smoothed cranial scan; anatomical helmet alignment marker and landmark data; the detailed helmet shell, liner, and hardware design for the elements that are not being customized; the desired scan surface areas for additional purchase and relief for comfort and stability including the desired amount of purchase/relief and purchase, relief three-dimensional profile; the desired purchase for hair and hair garments; the user's susceptibility to concussion or traumatic brain injury based upon prior incidents or a desire for additional impact absorption capacity; the purchase and reliefs will have defaults for each helmet 10 type and design for the common scenario where helmet fitters lack training and experience; defaults may also be utilized to increase process efficiency and to reduce total manufacturing costs.

A critical function of the software algorithm is scan shape alignment and first outer shell 40 alignment and positioning. This alignment and positioning defines the three-dimensional space to be filled with a custom foam and polymer liner 20. The scan shape alignment is to be based upon anatomical landmarks, creation of an anatomical coordinate system, and statistical analysis of three-dimensional radial vectors. The first outer shell 40 selection, alignment, and positioning over the scan shape is based upon the scan shape alignment and coordinate system, helmet placement landmarks, and purchases and reliefs for hair and hair garments, quantified local/global comfort capacity, quantified local/global stabilization capacity, and quantified local/global shock absorption capacity. The majority of algorithm outputs can be calculated and geometrically determined based upon the detailed helmet 10 design, aligned shapes, and manufacturing methods. The algorithm will have the option for full automation based upon default settings.

The software algorithm has the following outputs: the modular prefabricated first impact absorbing layer 45 liner segmented pieces and first comfort layer 46 segmented pieces including selection bin and location within the helmet 10; manufacturing process and material selection specific details for flexible, water-resistant plastic air bladders 42; detailed first outer shell 40 and custom liner 20 assembly processes including all hardware.

Finally, the assemble liner to helmet step 66 is envisioned to utilize bonding methods such as, but not limited to, adhesives, fasteners, and the like, to produce a finished helmet 10.

It is understood that default processes may be used throughout these design outputs to increase process efficiency and to reduce total manufacturing cost.

The CAD modified or original three-dimensional cranial surface scan and the inner surface of the thinner, stiffer outer shell 40 may be transformed to a relatively flat contoured surface for an inner soft liner. Topographic maps can be utilized that represent the three-dimensional and/or directional distance between the outer helmet shell 40 or foam liner 20 and the modified three-dimensional scan. The soft liner 20 is to be constructed from segmented, three-dimensional polygon and geometric shaped foam cells 22 with thinner plastic or foam connecting webs 44 acting as living hinges to make the relatively flat liner 20 fold and deform to create the desired variable thickness three-dimensional shape that matches the scanned cranial shape intimately on the inside and the inner surface of the outer shell 40 on the outside. The mismatch and air gaps 48 between the inner prefabricated standardized shapes and the user's cranial shape are frequently present with existing commercially available helmet designs 110. The foam cells 22 including the first impact absorbing layer 45 and the first comfort foam layer 46 are sealed within a thin, moisture resistant plastic bladder 42 a skin or encapsulated in a thin, moisture resistant plastic material which may also form a bladder 42 for inflation to fine tune the shape and subsequent fit.

The three-dimensional shape and thickness of the custom liner 20 may be created in a unique, cost-effective way by algorithm determined selection of prefabricated geometric foam or polymer segments 24 from an organized pre-sized and pre-shaped inventory of foam or polymer segments 24. The selected first impact absorbing layer 45 materials may be different for local areas within the helmet 10 to enhance the shock absorbing performance in susceptible areas. The prefabricated foam or polymer segments 24 may be stored in bins by shape, size, foam type, and foam layer thickness.

The selection and orientation of the foam segments 24 will be determined with a software algorithm that calculates the variable thickness and three-dimensional shape contours between the inner and outer surfaces based upon the position inside the helmet 10 and the desired shock absorption. The foam segments 24 may be manufactured via compression molding, injection molding, casting, milling, or grinding. The sets of foam segments 24 are then placed inside the plastic bladders 42 within thermoforming molds, compression molds, or other heated molds for encapsulating the foam segments 24 within the bladders 42. The bladders 42 may also be utilized in series with a foam liner. Serial bladders 42 are to be rotationally molded, blow molded, thermoformed, or compression molded. The bladders 24 may be inflated in the preferred embodiment for minimal fine tuning to a custom shape rather than to fill larger air gaps 48 to accommodate the normal head shape variations as required with prefabricated helmets 110. Larger air gaps 48 inside bladders 42 filled with air 43 may add comfort and if properly inflated will help hold the helmet 10 in place during use prior to an impact load 30 but contribute minimally to the absorption of the extreme forces experienced during protective helmet impact events. These larger air gaps 48 provide minimal support and can create a significant secondary impact between the liner and the cranium 100.

Each thermoforming or heat molding process utilized to form the bladders 42 requires two (2) thin vinyl or other water resistant, flexible thermoplastic sheets that are heated and inserted into a vacuum thermoforming mold, compression mold, or other heat molding tool. The sheets may be die cut or trimmed prior to and/or after the thermoforming or heat molding process. The inner thermoformable or heat moldable sheet remains relatively flat and the outer sheet contours to the shape of the foam segment 24 and is sealed between and around the foam segments 24 to form web portions 44. The webs 44 may allow for air flow between adjacent bladders 42 as desired within the custom liner 20. Mechanical fastening means and/or air valves may also be molded into the thermoplastic sheets during this heat forming step. The custom liner 20 may be thermoformed, compression molded, or heat molded in an open or closed cavity manufacturing mold to create the desired shape. The molded custom liner 20 may then be die cut, trimmed, and finished to create the final net shape as needed.

The prefabricated, modular, segmented, custom located foam or polymer cell designs 22 of the first fabrication method 60 allow for customization utilizing efficient manufacturing processes and equipment that are cost competitive with existing entirely prefabricated helmet liners. High fabrication costs, rapid prototyped and injected/cured material options were, and continue to be, major issues with previous development efforts to create fully customized helmet designs.

FIG. **6*b* is another process flow diagram depicting a second fabrication method 70 of the present invention, according to an alternate method. The second fabrication method 70 and design can include a cranial shape acquisition step 62, which provides a custom scan of the user's cranium 100 and creates a surface model from the scan data; a modify scan step 63 which modifies the cranial shape acquisition data for optimal helmet 10 comfort and stability; a design liner step 64, which selects an appropriate size and shape for the first outer shell 40, overlays the model of the outer shell 40 onto the modified cranial model, and optimizes and designs the foam custom liner 20, select the appropriate foam or polymer liner blank matched to the outer shell 40; a mill liner blank step 75 which mills the custom liner 20 to the optimized shape preferably using a CNC tool; an assemble liner to helmet step 66 to assemble the finished first outer shell 40 with the custom liner 20 to produce a finished helmet 10; and, finally a fit to user step 68**.

Specifically for the second method 70, a single-density or multi-density soft inner liner 20 is created by CNC milling the inside of a prefabricated, preformed liner blank to match the CAD modified cranial 3-dimensional scan with the outside of the blank matching the prefabricated inside surface of the rigid first outer shell 40. The blank may be a single monolithic density or a composite with a soft inner layer and stiffer outer shock absorbing layer. The bladders 42 described in the first fabrication method 60 can be utilized for fine tuning the fit, sealing the foam or polymer liner, and for anchoring fasteners and air valves. Air gaps 48 would again be significantly smaller than the gaps between a cranium 100 and a fully prefabricated molded liner 115 portion of a prefabricated helmet 110. Soft comfort layers 46 may be added after liner carving. This second fabrication method 70 and process is particularly applicable to single-use helmets 10 used for activities such as, but not limited to:

bicycling, skiing/snowboarding, motorsports, roller sports, batting, military, and the like, and premium/high end helmet market segments.

For the second fabrication method 70, the software algorithm has the following outputs: the helmet liner blank selection and specification; the inner surface model to be carved into the blank; manufacturing processes and material selection specific details for first comfort foam 46, air bladders 42; detailed first outer shell 40 and custom liner 20 assembly processes including all hardware.

Referring now to FIG. 7, an illustration of alignment markers 80 indicating surface anatomical landmarks, to be utilized during the cranial shape acquisition step 62 (see FIGS. 6*a* and 6*b*), according to a preferred embodiment of the present invention, is disclosed. The three-dimensional surface scan is to include the entire cranium 100 and the face including every surface area to be covered by the protective helmet. It is envisioned that detectable alignment markers 80 be used to indicating surface anatomical landmarks during creation of an anatomical coordinate system and for alignment and positioning of the helmet 10.

The alignment markers 80 are to be adhesively affixed to areas of the cranium 100 including, but not limited to: the tragion, the sellion, the eurion, and the suboccipital notch/prominence. The markers 80 may be placed on the user's cranium 100 and facial portions for use during the cranial shape acquisition step 62 to provide an anatomical coordinate system and for alignment and positioning of the helmet 10. Palpable or easily discernible clear surface anatomical landmarks are crucial particularly for algorithm based anatomical alignment and positioning. Landmarks may also be placed for helmet 10 positioning including the midline of the helmet edge above the nose, suboccipital midline for posterior-inferior helmet placement, ear profile, cheek/mandible helmet placement, or facemask placement.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the system 10, it would be installed as indicated in FIG. 1.

The preferred fabrication method 60 of producing a model of the helmet 10 (see FIG. 6*a*), being of a desired size, design, and appearance may be achieved by performing the following steps: subjecting a user to a non-contact laser scanner or other cranial scanner to perform a cranial scan (step 62) which provides a custom scan of the user's cranium 100 and creates a surface model using the scan data; applying CAD software to modify the cranial scan data (step 63) for optimal helmet 10 comfort and stability; applying a software algorithm to design the custom liner (step 64) which selects an appropriate size and shaped for the first outer shell 40, overlays the model of the outer shell 40 onto the modified cranial model, and designs and arranges the segmented composite cells 22 and bladders 42; assembling the custom liner 20 to helmet shell 40 (step 66) using adhesives, mechanical fasteners, or the like; and, finally fitting the helmet 10 to user (step 68).

The method of utilizing the helmet 10 may be achieved by performing the following steps: donning the helmet 10 in preparation for participating in a sporting event or similar activity; experiencing normal impact load 30 occurrences associated with the activity; allowing the reduced number and size of air gaps 48 formed between the custom liner 20 and a user's cranium 100, as well as improved intimate contact between the custom liner 20 and the cranium 100 to provide superior protection from concussion and brain trauma injuries due to minimized secondary impact between the liner and the cranium 100; benefiting from the comfort, stability, impact absorption, and slower brain deceleration within the cranium 100 resulting from the customized and optimally tuned design of the custom liner 20; and, benefiting from a level of safety associated with custom designed helmets 10 at a reduced manufacturing cost using the present invention 10.

The second fabrication method 70 of producing a model of the helmet 10 may be achieved in a similar manner as the previously described preferred embodiment, but is to include the following additional steps: utilizing a design liner process step (step 64) to select an appropriate foam or polymer liner blank being matched to the selected outer shell 40; milling the liner blank (step 75), preferably using a CNC tool, to an optimized shape as defined by the software algorithm portion of the second fabrication method 70; assembling the milled liner to the helmet shell 40 (step 66) as described above.

During the previously described cranial shape acquisition step 62, mobile laser scanners may be utilized for scanning custom cranial shapes and fitting users at remote facilities. Such scanning equipment preferably includes a non-contact laser scanner or other cranial scanner, computer hardware/software for the scanning process, designing the custom liner 20 or surface model, and ordering the helmet and equipment for fitting and fine tuning the protective helmet 10. It is envisioned that manufacturing at a separate facility could provide quick production and product turnaround.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A method for customizing and fabricating a helmet, said method includes the steps of:

providing a cranium to customize said helmet thereto;

performing a three-dimensional surface scan of said cranium;

acquiring a cranial shape from said a three-dimensional surface scan of said cranium;

generating a surface model of said cranial shape;

modifying said surface model to generate a modified surface model to smooth cranial topography of said cranial shape for optimal comfort and stability of said helmet;

performing a design liner process comprising:

generating an outer shell model representing a size and shape of a corresponding outer shell of said helmet;

overlaying said outer shell model onto said modified surface model;

determining a geometry and dimension of a gap defined between said modified surface model and said outer shell model;

determining a pattern of a plurality of discrete geometric shapes configured to fill said gap; and recommending a plurality of discrete prefabricated geometric segments, each of said plurality of discrete prefabricated geometric segments having a predefined size and shape corresponding to one of said plurality of discrete geometric shapes, wherein each of said plurality of discrete prefabricated geometric segments comprises an impact layer and a comfort layer; and performing an assembly process comprising:

providing said outer shell corresponding to said outer shell model;

providing a liner comprising an inward surface and an outward surface;

connecting said plurality of discrete prefabricated geometric segments to said inward surface of said liner according to said pattern of said plurality of discrete geometric shapes, wherein said impact layer is positioned proximate to said liner, said comfort layer is positioned remote to said liner and said liner forms an interconnecting web between said plurality of discrete prefabricated geometric segments;

connecting an encapsulating cover to said inward surface of said liner to form air bladder around said plurality of discrete prefabricated geometric segments to form a pattern of a plurality of discrete cells formed from said plurality of discrete prefabricated geometric segments and said air bladders matching said pattern of said plurality of discrete geometric shapes;

fluidly interconnecting said air bladders of said plurality of discrete prefabricated geometric segments to allow air flow between adjacent ones of air bladders; and connecting said outward surface of said liner to an interior of said outer shell, wherein said plurality of discrete cells conform to said cranium shape such that no air gaps are formed between cranium and said plurality of discrete cells, and wherein each of said plurality of discrete cells is configured to disperse energy through said plurality of discrete cells in response to an impact load generated by an impact event.

2. The method as set forth in claim 1, wherein said cranial shape acquisition process step further includes the step of employing a non-contact laser scanning technique of projecting light and cameras to image said projected light on said cranium to create said surface model.

3. The method as set forth in claim 2, wherein said cranial shape acquisition process step further includes the step of employing multiple fanned lasers to project said light circumferentially around said cranium.

4. The method as set forth in claim 2, wherein said cranial acquisition process step further includes the step of covering said cranium with a conformable material to compress a scalp and any hair on said cranium prior to employing said non-contact laser scanning technique.

5. The method as set forth in claim 2, wherein said cranial acquisition process step further includes the step of moistening hair on said cranium with lubrication to simulate actual usage conditions without stray hairs prior to employing said non-contact laser scanning technique.

6. The method as set forth in claim 2, wherein said cranial acquisition process step further includes the step of triangulating said images and combining said images to create said surface model with surface lofting, sweeping, meshing, and interpolation.

7. The method as set forth in claim 1, wherein said cranial shape acquisition process step further includes the step of employing a scanning technique selected from the group consisting of computerized tomography, magnetic resonance imaging, photogrammetry scanning, infrared/ultraviolet light scanning, and flexible, contourable, stretchable fabrics that conform to said cranium and contain a matrix of shape and position sensors to create said surface model.

8. The method as set forth in claim 1, wherein said cranial shape acquisition process step further includes the step of placing detectable alignment markers indicating surface anatomical landmarks to said cranium for alignment and positioning of said helmet and said liner.

9. The method as set forth in claim 1, wherein said modified scan process step further includes the step of employing a computer aided design software to modify said three-dimensional surface scan to optimize pressure distribution, fit, and subsequent stability and shock absorbing performance.

10. The method as set forth in claim 1, wherein said modified scan process step further includes the step of employing a haptic feedback surface modification hardware/software to modify said three-dimensional surface scan to optimize pressure distribution, fit, and subsequent stability and shock absorbing performance.

11. The method as set forth in claim 1, wherein said modified scan process step further includes the step of creating standardized modifications via algorithms of a software performing said modified surface model.

12. The method as set forth in claim 1, wherein said design liner process step further includes the step of selecting a design of said outer shell and said custom liner based upon said three-dimensional surface scan and a desired shock and impact absorption capacity and optimizing said design for size, shape, and cost-effective manufacture.

13. A method for customizing and fabricating a helmet, said method includes the steps of:

providing a cranium to customize said helmet thereto;

performing a three-dimensional surface scan of said cranium;

acquiring a cranial shape from said three-dimensional surface scan of said cranium;

generating a surface model of said cranial shape;

modifying said surface model to generate a modified surface model to smooth cranial topography of said cranial shape for optimal comfort and stability of said helmet;

performing a design liner process comprising:

generating an outer shell model representing a size and shape of a corresponding outer shell of said helmet;

overlaying said outer shell model onto said modified surface model;

determining a geometry and dimension of a gap defined between said modified surface model and said outer shell model;

determining a pattern of a plurality of discrete geometric shapes configured to fill said gap; and generating a pattern of a plurality of discrete cells matching said pattern of plurality of discrete geometric shapes, each of said plurality of discrete cells having a size and shape corresponding to one of said plurality of discrete geometric shapes; and performing an assembly process comprising:

providing said outer shell corresponding to said outer shell model;

providing a mill liner blank comprising an inward surface and an outward surface, said mill liner blank further comprising an impact layer and a comfort layer;

milling said mill liner blank to form a customized liner comprising said plurality of discrete cells arranged according to said pattern of said plurality of discrete cells; and connecting said outward surface of said liner to an interior of said outer shell, wherein said plurality of discrete cells conform to said cranium shape such that no air gaps are formed between cranium and said plurality of discrete cells, and wherein each of said plurality of discrete cells is configured to disperse energy through said plurality of discrete cells in response to an impact load generated by an impact event.

14. The method as set forth in claim 13, wherein said cranial shape acquisition process step further includes the step of employing a non-contact laser scanning technique of projecting light and cameras to image said projected light on said cranium to create said surface model.

15. The method as set forth in claim 14, wherein said cranial shape acquisition process step further includes the step of employing multiple fanned lasers to project said light circumferentially around said cranium.

16. The method as set forth in claim 14, wherein said cranial acquisition process step further includes the step of covering said cranium with a stretchable fabric to compress a scalp and any hair on said cranium prior to employing said non-contact laser scanning technique.

17. The method as set forth in claim 14, wherein said cranial acquisition process step further includes the step of moistening hair on said cranium with lubrication to simulate actual usage conditions without stray hairs prior to employing said non-contact laser scanning technique.

18. The method as set forth in claim 14, wherein said cranial acquisition process step further includes the step of triangulating said images and combining said images to create said surface model with surface lofting, sweeping, meshing, and interpolation.

19. The method as set forth in claim 13, wherein said cranial shape acquisition process step further includes the step of employing a scanning technique selected from the group consisting of computerized tomography, magnetic resonance imaging, photogrammetry scanning, infrared/ultraviolet light scanning, and flexible, contourable, conforming materials that conform to said cranium and contain a matrix of shape and position sensors to create said surface model.

20. The method as set forth in claim 13, wherein said cranial shape acquisition process step further includes the step of placing detectable alignment markers indicating surface anatomical landmarks to said cranium for alignment and positioning of said helmet and said liner.

21. The method as set forth in claim 13, wherein said modified scan process step further includes the step of employing a computer aided design software to modify said three-dimensional surface scan to optimize pressure distribution, fit, and subsequent stability and shock absorbing performance.

22. The method as set forth in claim 13, wherein said modified scan process step further includes the step of employing a haptic feedback surface modification hardware/software to modify said three-dimensional surface scan to optimize pressure distribution, fit, and subsequent stability and shock absorbing performance.

23. The method as set forth in claim 13, wherein said modified scan process step further includes the step of creating standardized modifications via algorithms of a software performing said modified surface model.

24. The method as set forth in claim 13, wherein said design liner process step further includes the step of selecting a design of said outer shell and said custom liner based upon said three-dimensional surface scan and a desired shock and impact absorption capacity and optimizing said design for size, shape, and cost-effective manufacture.

25. The method as set forth in claim 13, wherein said mill liner blank milling step further includes the step of employing a CNC tool to mill said custom liner so that said plurality of discrete cells are formed in said inward surface and said outward surface of said liner matches said interior surface of said outer shell.

26. The method set forth in claim 13, wherein said performing an assembly process step further comprises:

connecting an encapsulating cover to said inward surface of said customized liner to form air bladder around said plurality of discrete cells; and fluidly interconnecting said air bladders of said plurality of discrete cells to allow air flow between adjacent ones of air bladders.

27. The method set forth in claim 13, wherein said performing an assembly process step further comprises adding additional comfort layers after said mill liner blank milling step is performed.

28. The methods set forth in claim 8, wherein said cranial acquisition step further includes the steps of:

adhesively affixing alignment markers to areas of said cranium and a face of said cranium;

creating said surface model of an entire surface of said cranium and said face;

adhesively affixing alignment markers to said helmet; and, using data from said alignment markers to create an anatomical coordinate system for proper placement and positioning of said helmet and said liner on said cranium.

29. The method set forth in claim 20, wherein said cranial acquisition step further includes the steps of:

adhesively affixing alignment markers to areas of said cranium and a face of said cranium;

creating said surface model of an entire surface of said cranium and said face;

adhesively affixing alignment markers to said helmet; and, using data from said alignment markers to create an anatomical coordinate system for proper placement and positioning of said helmet and said liner on said cranium.

* * * * *